US009585488B1

(12) United States Patent
Kalista

(10) Patent No.: US 9,585,488 B1
(45) Date of Patent: Mar. 7, 2017

(54) CHILD SEAT FOR A SWIMMING POOL

(71) Applicant: Marie R. Kalista, Britton, MI (US)

(72) Inventor: Marie R. Kalista, Britton, MI (US)

( * ) Notice: Subject to any disclaimer, the term of this patent is extended or adjusted under 35 U.S.C. 154(b) by 86 days.

(21) Appl. No.: 14/563,376

(22) Filed: Dec. 8, 2014

Related U.S. Application Data

(60) Provisional application No. 61/977,855, filed on Apr. 10, 2014.

(51) Int. Cl.

| | |
|---|---|
| ***A47C 3/20*** | (2006.01) |
| ***A47C 15/00*** | (2006.01) |
| ***B63C 9/30*** | (2006.01) |
| ***E04H 4/14*** | (2006.01) |
| ***A47D 1/00*** | (2006.01) |
| ***A47C 7/66*** | (2006.01) |
| ***A47C 7/00*** | (2006.01) |
| ***A47C 3/34*** | (2006.01) |

(52) U.S. Cl.
CPC ..... *A47C 15/006* (2013.01); *A47C 3/20* (2013.01); *A47C 3/34* (2013.01); *A47C 7/002* (2013.01); *A47C 7/66* (2013.01); *A47D 1/004* (2013.01); *A47D 1/008* (2013.01); *B63C 9/30* (2013.01); *E04H 4/14* (2013.01)

(58) Field of Classification Search
CPC B63C 9/30; A47C 7/66; A47C 15/006; A47C 3/20; A47C 3/34; A47C 3/40; A47C 7/002; A47D 1/004; A47D 1/008; E04H 4/14
USPC ..... 441/129–132; 446/153
See application file for complete search history.

(56) References Cited

U.S. PATENT DOCUMENTS

| | | | | |
|---|---|---|---|---|
| 1,962,184 | A * | 6/1934 | Eiserman | A63B 35/00 472/13 |
| 2,720,249 | A * | 10/1955 | Peterson | A47C 9/10 108/141 |
| 2,938,726 | A * | 5/1960 | Hunter, Jr. | A63G 23/00 114/311 |
| 4,008,497 | A * | 2/1977 | Badon | E04H 4/065 4/487 |
| 4,799,910 | A | 1/1989 | Kellough | |
| 5,299,588 | A * | 4/1994 | MacLeod | A45B 11/00 135/16 |
| 5,505,645 | A * | 4/1996 | Engler, Jr. | A45B 23/00 135/16 |
| 5,823,121 | A * | 10/1998 | Reiter | A47B 37/00 108/147.19 |
| 5,993,276 | A | 11/1999 | Ponton et al. | |
| 6,126,504 | A | 10/2000 | Day | |
| 6,209,150 | B1 | 4/2001 | Hsu et al. | |
| 6,571,403 | B2 * | 6/2003 | Wheaton | E04H 12/2261 4/496 |

(Continued)

OTHER PUBLICATIONS http://www.swimways.com/infant-baby-pool-floats-c-40.aspx (May 30, 2013).

*Primary Examiner* — Ajay Vasudeva
(74) *Attorney, Agent, or Firm* — Robert C. Montgomery; Montgomery Patent & Design

(57) ABSTRACT

A child seat apparatus for use in a swimming pool includes a frame assembly including an opposed and parallel pair of side frames, a vertical adjusting assembly movably connected to the pair of side frames, a floatable seat assembly connected to the vertical adjusting assembly between the pair of side frames, and a weighted base connected to the frame assembly.

17 Claims, 4 Drawing Sheets

(56) References Cited

U.S. PATENT DOCUMENTS

| | | | | |
|---|---|---|---|---|
| 6,749,474 | B2 | 6/2004 | Hsu et al. | |
| 7,293,840 | B1 * | 11/2007 | Schu | B63C 9/30 297/448.2 |
| 7,887,383 | B1 | 2/2011 | Pott | |

* cited by examiner

CHILD SEAT FOR A SWIMMING POOL

RELATED APPLICATIONS

The present invention is a continuation-in-part of, was first described in, and claims the benefit of U.S. Provisional Application No. 61/977,855, filed Apr. 10, 2014, the entire disclosures of which are incorporated herein by reference.

FIELD OF THE INVENTION

The present invention relates generally to child seats and, more particularly, to child seat that includes a base that is securable to a bottom of a swimming pool and a frame that extends upward from the base.

BACKGROUND OF THE INVENTION

Young children are delicate little beings that require the utmost care in order protect and keep them safe from harm. As a result, there are a myriad of products intended to provide protection from the danger generated by a variety of sources. Car seats protect them from physical harm while riding in a car, and sunshades shield their eyes and skin from the harmful effects of ultraviolet light. High chairs secure them at the dinner table, and barriers keep them from falling down stairs, and out of beds. The list goes on and on.

While there appears to be a product intended to protect infants from a seemingly endless list of dangers, one (1) learning experience they are not protected from is when they are in the water. Of course an adult or care provider can hold them, but then they are isolated from the water, and generally prohibited from playing in it. Additionally, the parent or care provider is then unable to help, care for, or assist other children who may be in the water as well.

Accordingly, there is a need for a means by which young children can be protected from harm when in any type of body of water, yet be afforded a playful and fun experience.

SUMMARY OF THE INVENTION

The inventor has recognized the aforementioned inherent problems and lack in the art and observed that there is a need for a child seat for a swimming pool that provides increased safety for infants during water-based recreation. The development of the present invention, which will be described in greater detail herein, substantially departs from conventional solutions to fulfill this need.

In one (1) embodiment, the disclosed child seat apparatus for use in a swimming pool includes a floatable seat assembly configured to support a child occupant upon a water surface, and a frame assembly removably connected to the seat assembly and supported on a bottom surface of said swimming pool.

In another embodiment, the disclosed child seat apparatus for use in a swimming pool includes a frame assembly including an opposed and parallel pair of side frames, a vertical adjusting assembly movably connected to the pair of side frames, a floatable seat assembly connected to the vertical adjusting assembly between the pair of side frames, and a weighted base connected to the frame assembly.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
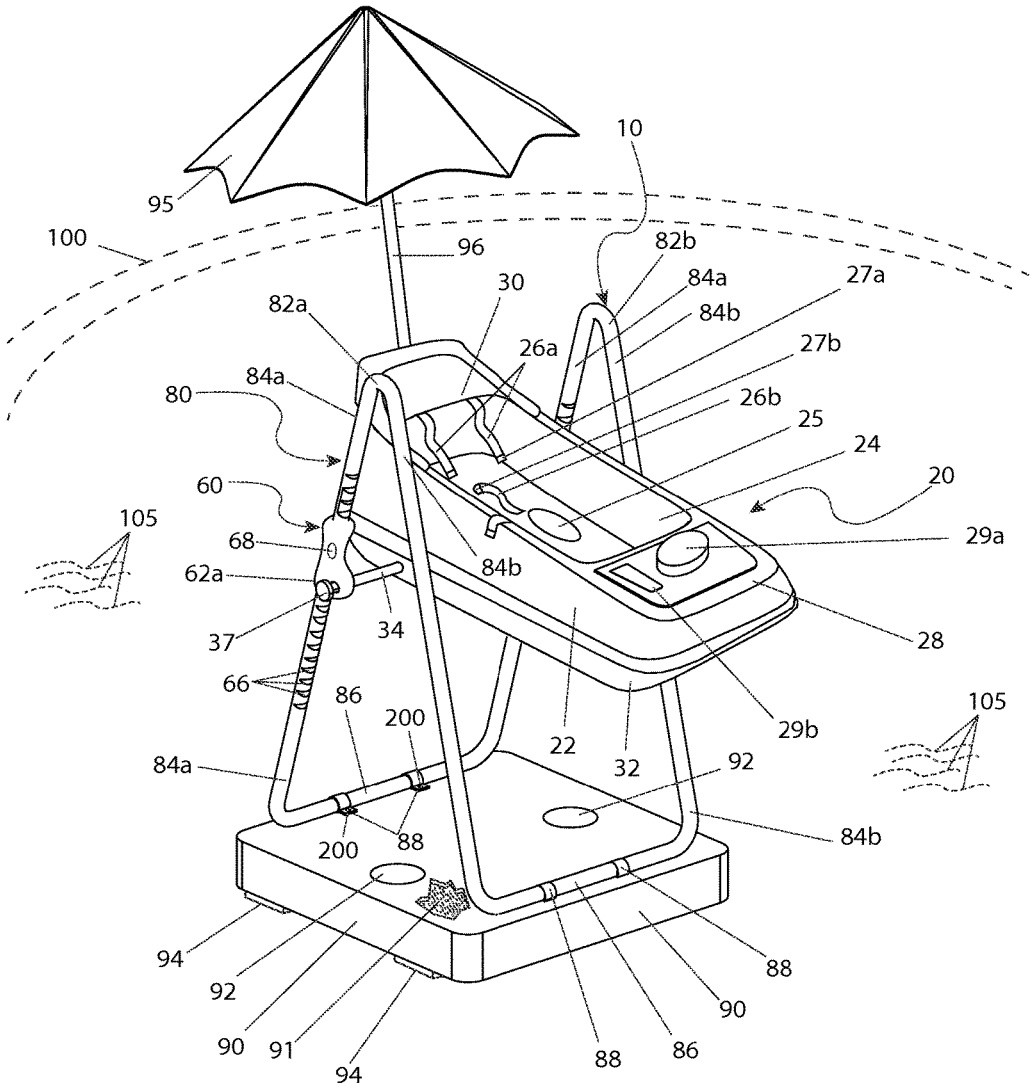
FIG. 1 is an environmental perspective view of the disclosed child seat for a swimming pool, according to one (1) embodiment of the present invention.

10 child seat apparatus
20 seat assembly
22 seat frame
24 seat compartment
25 leg aperture
26*a* upper safety strap
26*b* lower safety strap
27*a* upper fastener
27*b* lower fastener
28 tray
29*a* first tray accessory
29*b* second tray
30 padded backrest
32 flotation member
40 pivot rod
42 head
43 male threaded region
45 knob
46 female threaded region
60 vertical adjusting assembly
62*a* first handle
62*b* second handle
63 handle aperture
64*a* first rod aperture
64*b* second rod aperture
65 release mechanism
66 groove
67 tip
68 pivot pin
69 spring
80 frame assembly
82*a* right-side frame
82*b* left-side frame
84*a* rear frame member
84*b* front frame member
86 bottom frame member
88 frame bracket
90 base
91 filler material
92 fill plug

94 anti-skid pad
95 umbrella
96 umbrella pole
97 umbrella aperture
100 swimming pool
105 water surface
200 fastener
202 fastener aperture

DETAILED DESCRIPTION OF THE PREFERRED EMBODIMENT

In accordance with the invention, the best mode is presented in terms of a one or more of the disclosed embodiments, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-4, disclosing a child seat apparatus (herein described as the "apparatus") 10 for swimming pools, where like reference numerals represent similar or like parts. Generally, the disclosed apparatus 10 provides a multipurpose stationary or floating restraining system for an infant or child within a swimming pool 100 or similar environment.

The apparatus 10 can be used in both above-ground pools and in-ground pools and utilizes a frame assembly 80 and a weighted base 90 to securely position the apparatus 10 on a bottom surface of the pool 100. The frame assembly 80 supports a child seat assembly 20 and provides height adjustment to position the seat assembly 20 upon a water surface 105 within the swimming pool 100. The apparatus 10 leaves both arms of a care-giver or parent free to attend to other tasks, or play with the child in the water. Furthermore, the seat assembly 20 may be detached from the frame assembly 80 and used as a stand-alone child floatation device if desired.

Referring to FIG. 1, the apparatus 10 includes the child or infant seat assembly 20. The seat assembly 20 is adjustably supported upon the frame assembly 80. The frame assembly 80 is mounted to and stabilized by the weighted base 90. The weighted base 90 rests upon the bottom surface of the pool 100.

The seat assembly 20 provides for comfortable seated positioning of an occupant, such as an infant of small child. The seat assembly 20 includes an oval or wedge shaped molded plastic seat frame 22 that provides for attachment to various safety, entertainment, and comfort features. The seat frame 22 includes, but not limited to, a textile-lined recessed seat compartment 24 having a pair of leg apertures 25, a padded backrest 30, a pair of upper safety straps 26*a*, a pair of lower safety straps 26*b*, and an accessory tray 28.

The seat compartment 24 is connected along a top perimeter edge to the seat frame 22, for example, using a plurality of fasteners, such as rivets or the like.

The safety straps 26*a*, 26*b* are envisioned to be made using durable strapping material. Each lower safety strap 26*b* is envisioned to be anchored to the seat compartment 24 so as to align with the infant's crotch area. The lower safety strap 26*b* includes a lower fastener 27*b* located at a distal end thereof. Each upper safety strap 26*a* is envisioned to be anchored along a rear edge of the seat compartment 24. The upper safety strap 26*a* includes an upper fastener 27*a* located at a distal end thereof. The fasteners 27*a*, 27*b* are envisioned to be correspondingly mated together such that the straps 26*a*, 26*b* extend over the shoulder area of the occupant.

It is understood that different models of the seat assembly 20 may be introduced having differently sized seat compartments 24 based upon a size of an occupying infant, and as such should not be interpreted as a limiting factor of the apparatus 10.

The tray 28 is integral to the seat frame 22 and extends in a forward direction having sufficient top surface area for arrangement of a plurality of infant entertaining features. The plurality of infant entertaining features can include, but is not limited to, a first tray accessory 29*a* and a second tray accessory 29*b*.

The seat frame 22 also provides adhesive or equivalent attachment means to a subjacent flotation member 32 connected along bottom outer perimeter edge. The flotation member 32 provides additional flotation and buoyant leveling of the seat assembly 20 upon the water surface 105 during use. The flotation member 32 is envisioned to have a round or oval-shaped cross-section and to be made of a closed-cell plastic foam material.

The seat frame 22 also provides an integral umbrella aperture 97 along a top surface, which enables partial insertion of a handle pole 96 of an umbrella 95 to be used to protect the infant occupant in the event of intense sunshine.

The seat assembly 20 is rotatingly and adjustably connected to the frame assembly 80 via a vertical adjusting assembly 60.

Figure 2:
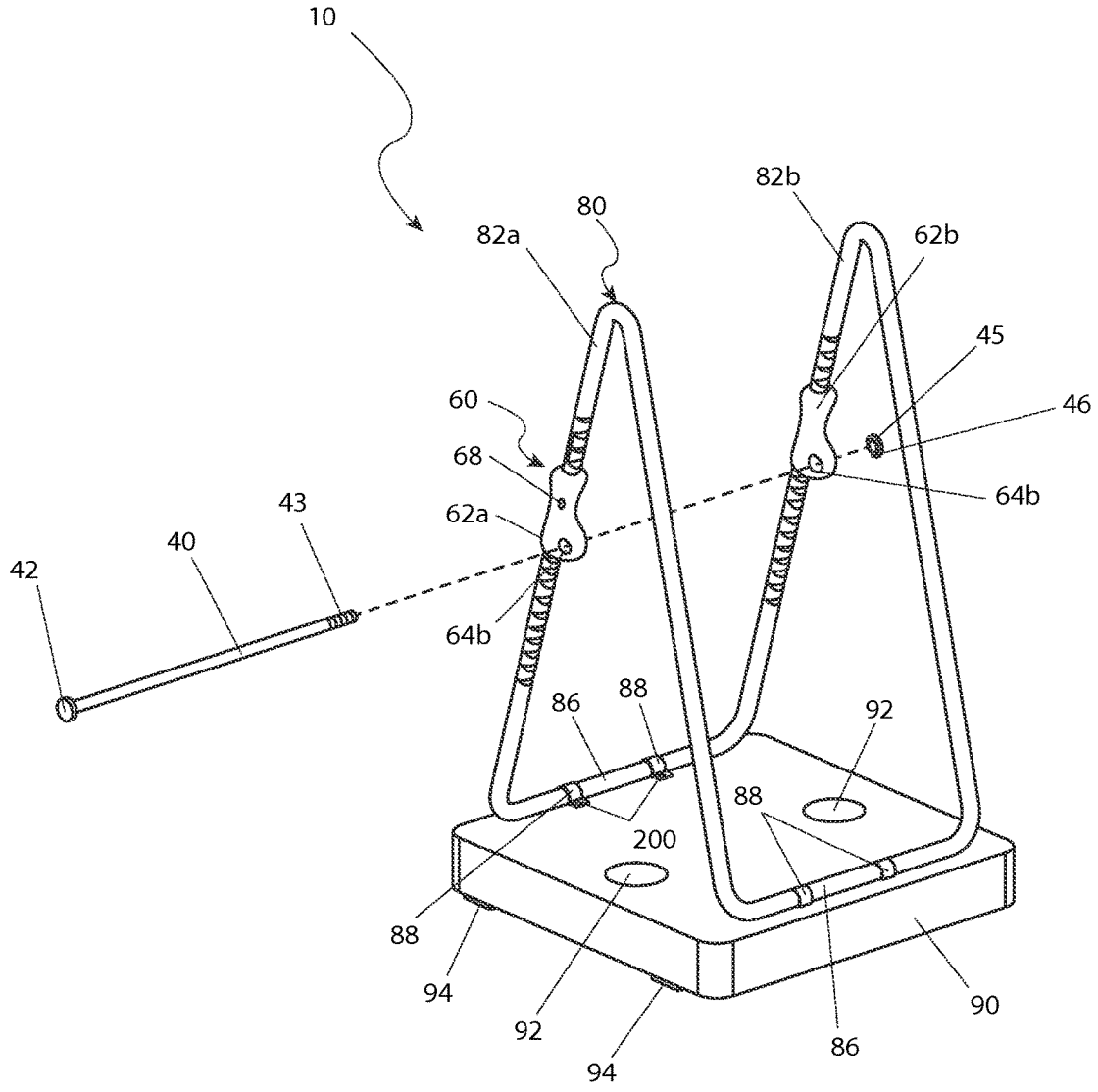
FIG. 2 is a partially exploded perspective view of a frame assembly of the child seat for a swimming pool, according to one (1) embodiment of the present invention.

Referring to FIGS. 1 and 2, the frame assembly 80 supports the child seat assembly 20 as well as provides vertical adjustment of the seat assembly 20 upon the water surface 105. The frame assembly 80 is preferably made using a plastic or metal tubular material forming right-side frame 82*a* and a left-side frame 82*b*. The side frames 82*a*, 82*b* include inverted "V"-shaped forms and are arranged in a relative parallel manner on each side of the seat assembly 20, having divergent rear frame member 84*a* and front frame member 84*b* that extend downwardly to the base 90.

The two (2) rear frame members 84*a* are connected by an integral horizontal bottom frame member 86 extending across and being fastened to a top surface of the base 90 via a plurality of frame brackets 88 The front frame members 84*b* are joined in like manner by another bottom frame member 86. The frame brackets 88 securely fasten the bottom frame members 86 to the top surface of the base 90. The frame brackets 88 preferably include "C"-shaped fittings that wrap around respective tubular bottom frame members 86 and are fastened to the base 90 using corresponding fasteners 200.

It is understood that the frame assembly 80 and seat assembly 20 may be removed as a unit from the base 90 by a user, by removing the fasteners 200 and detaching the frame brackets 88, if desired. In this state, the apparatus 10, minus the base 90, may be utilized in a wading pool or similar structure having only the front frame members 84*b* occupying the wading pool.

The base 90 is preferably a rigid hollow plastic enclosure having a generally rectangular perimeter shape with rounded corners. The base 90 also includes at least one (1) press-in fill plug 92 along an exterior surface to enable filling and containment of a volume of filler material 91, envisioned to be a heavy material such as, but not limited to, a solid material such as concrete, a sand and/or gravel mixture, or the like.

It is envisioned that the base 90 includes a plurality of high-friction anti-skid pads 94 being adhesively bonded to or otherwise affixed along a bottom surface thereof. It is also envisioned that the base 90 may utilize additional means to establish a grip upon a bottom surface of the swimming pool 100 such as suction cups or other means, without limiting the scope of the apparatus 10.

The major portions of the apparatus 10 including the seat assembly 20, the frame assembly 80, the vertical adjusting assembly 60, and the base 90 are envisioned to be made of rugged, corrosion-resistant, waterproof materials, and introduced in various attractive colors and patterns based upon a user's preference.

Figure 4:
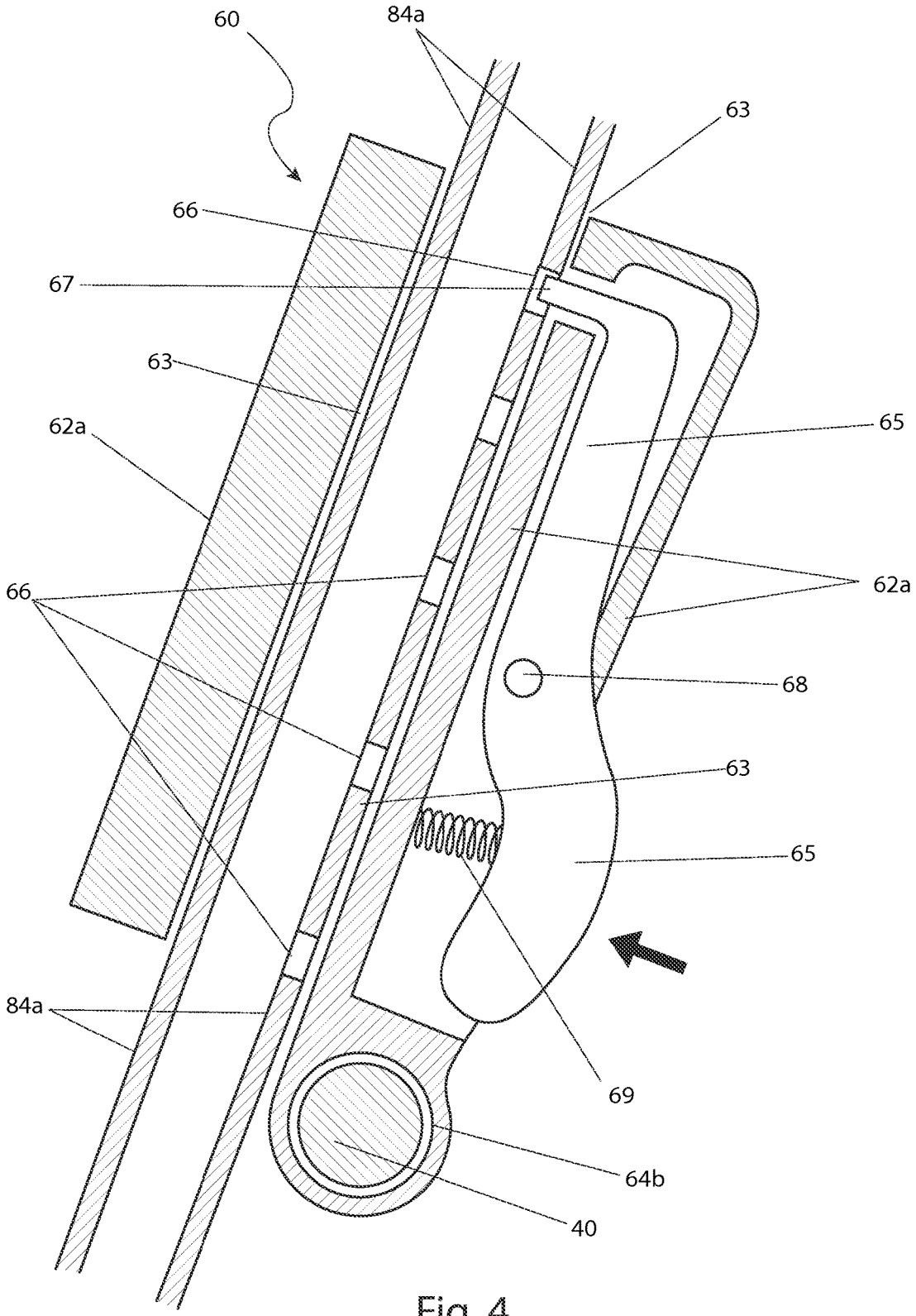

Referring to FIGS. 2 and 4, the frame assembly 80 includes the vertical adjusting assembly 60, which in turn includes a first handle 62*a* and a second handle 62*b* that engage and selectively lock onto integral grooves 66 of respective rear frame members 84*a*. The handles 62*a*, 62*b* include an interconnecting and removable pivot rod 40. The pivot rod 40 provides a means of rotary attachment of the seat assembly 20 to the vertical adjusting assembly 60, thereby allowing the seat assembly to partially float upon the water surface 105.

Figure 3:
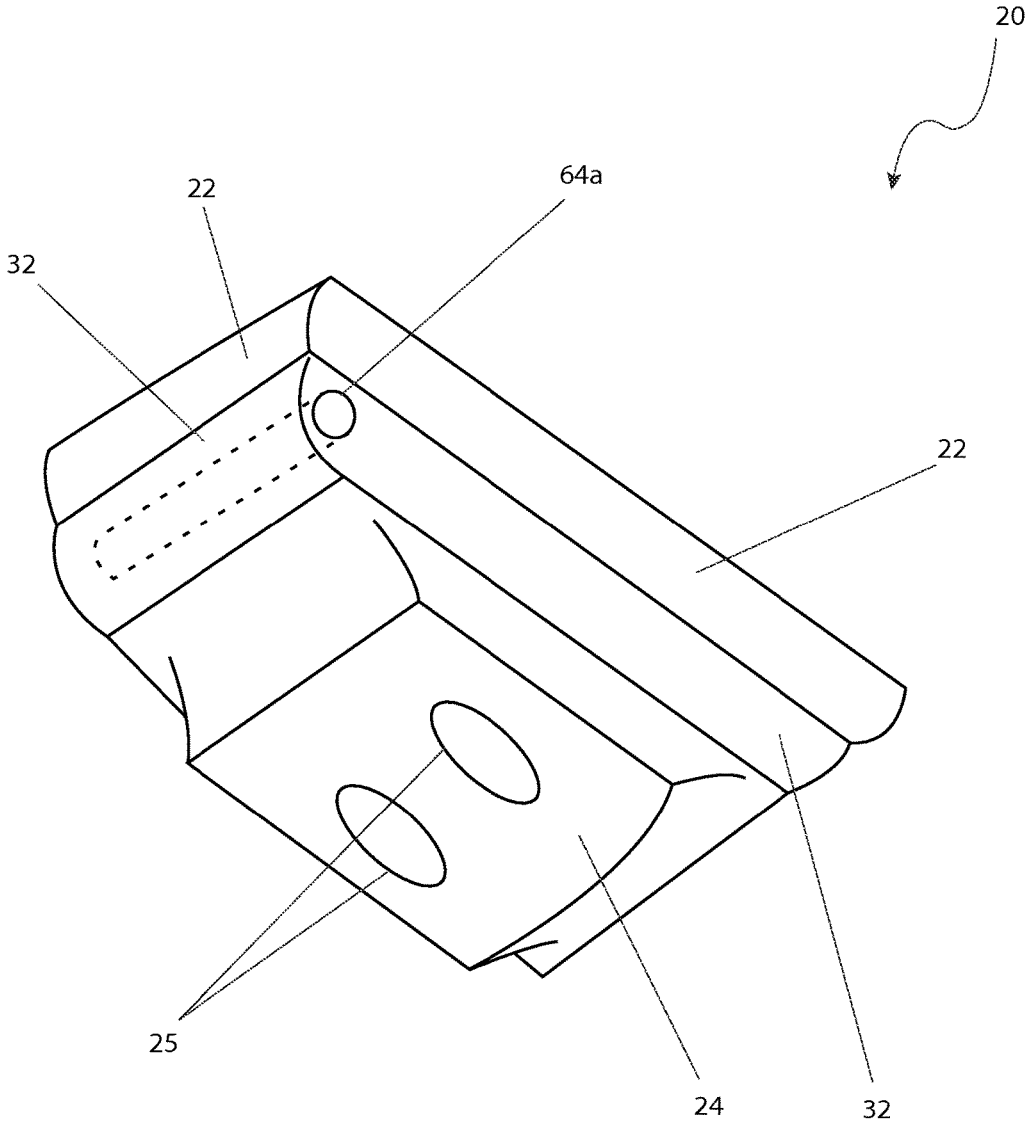
FIG. 3 is a bottom perspective view of a seat assembly of the child seat for swimming pool, according to a preferred embodiment of the present invention; and, FIG. 4 is a sectional view taken along section line A-A of FIG. 1 of a first handle of a vertical adjusting assembly of the child seat for a swimming pool, according to one (1) embodiment of the present invention.

Referring to FIGS. 2 and 3, additionally, the seat assembly 20 may be removed from the vertical adjusting assembly 60 to enable separate use of the seat assembly 20 by a care giver upon the water surface 105, if desired, while providing close supervision to the occupant. The seat assembly 20 provides removable attachment to the pivot rod 40 via a first rod aperture 64*a* (FIG. 3).

The pivot rod 40 also passes through the handles 62*a*, 62*b* via respective second rod apertures 64*b* (FIG. 2), thereby allowing the seat assembly 20 to rotate thereupon (FIG. 1). The pivot rod 40 includes a linear plastic member having a round cross sectional shape. The pivot rod 40 includes an integral cylindrical head 42 at one end and a removably and threadingly attached knob 45 at an opposing end. The pivot rod 40 retains attachment of the knob 45 via engagement of respective male threaded region 43 and female threaded region 46. Removal of the pivot rod 40 and seat assembly 20 is accomplished by removing the knob 45 and sliding the pivot rod 40 outwardly from the first 64*a* and second 64*b* rod apertures.

Referring to FIG. 4, each handle 62*a*, 62*b* includes a central cylindrical handle aperture 63 that slidingly encompasses a respective rear frame member 84*a*.

Referring now to FIG. 3, the seat assembly 20 includes the first rod aperture 64*a* that allows insertion of the pivot rod 40 (FIG. 2). The first rod aperture 64*a* is formed along a rearward bottom surface of the seat assembly 20, being sized to slidingly and rotatingly receive the pivot rod 40 therethrough. If desired, the seat assembly 20 may be removed from the vertical adjusting assembly 60 for separate use upon the water surface 105.

Referring to FIGS. 2 and 4, the vertical adjusting assembly 60 includes the first handle 62*a* and the second handle 62*b*, being joined by the pivot rod 40 via aligned second rod apertures 64*b* (FIG. 2). The handles 62*a*, 62*b* are used in conjunction with each other to operably position and secure the vertical adjusting assembly 60 along the respective rear frame members 84*a*, 84*b*.

The first handle 62*a* is shown in FIG. 4 for illustration; however, it is understood that the first 62*a* and second 62*b* handles represent mirror-images of each other. The first handle 62*a* includes the centrally located cylindrical handle aperture 63 through which the rear frame member 84*a* is slidingly inserted. The first handle 62*a* also includes a toggling release mechanism 65 that is rotatingly mounted upon an intermediately located pivot pin 68 of the first handle 62*a*.

When at rest, an exposed lower portion of the release mechanism 65 is biased outwardly via an internal compression-type spring 69. Coincidentally, a pointed tip 67, formed at a top end of the release mechanism 65, which faces forwardly towards the grooves 66, is biased inwardly so as to engage one (1) of a plurality of correspondingly positioned and equally-spaced grooves 66 formed along a surface of the rear frame member 84*a*, thereby holding the vertical adjusting assembly 60 at a selected height.

Manually pressing the release mechanisms 65 of both handles 62*a*, 62*b* in a coincidental manner, allows the vertical adjusting assembly 60 to slide up and down upon the rear frame members 84*a*. Upon obtaining a desired height, releasing the release mechanisms 65 causes engagement of the tips 67 into respective aligned grooves 66, thereby securing a vertical position of the vertical adjusting assembly 60 and the attached seat assembly 20.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The example embodiments of the present invention can be utilized by the user in a simple and effortless manner with little or no training After initial purchase or acquisition of the apparatus 10, it would be installed as indicated in FIG. 1.

One (1) embodiment of the disclosed method for installing and utilizing the apparatus 10 may be include a series of steps, including: 1). procuring a model of the apparatus 10 having a desired aesthetic color and appearance; removing the fill plugs 92 and adding a volume of filler 91 such as sand into the base 90; 2). replacing the fill plugs 92; 3). attaching the seat frame 22 to the vertical adjusting assembly 60, by removing the knob 45 from the pivot rod 40, if not previously removed; 4). inserting the pivot rod 40 through the first 64*a* and second 64*b* rod apertures of respective seat assembly 20 and vertical adjusting assembly 60; 5). replacing the knob 45 by threadingly engaging the male threaded region 43 and female threaded region 46 of respective pivot rod 40 and knob 45, and tightening; 6). submerging the base 90 below the water surface 105 of the swimming pool 100 until the anti-skid pads 94 of the base 90 contact the bottom surface of the swimming pool 100; 7). adjusting a height of the seat assembly 20 to position the seat assembly 20 along the water surface 105 by pressing upon the release mechanisms 65 of the first 62*a* and second 62*b* handles in a coincidental manner; 8). sliding the first handle 62*a* and second handle 62*b* up or down until obtaining a desired position of the seat assembly 20 based upon the height of the water surface 105; 9). placing an infant into the seat compartment 24; 10). inserting legs of the infant through the leg apertures 25; 11). allowing the occupant to recline against the padded backrest 30; 12). securing the infant within the seat compartment 24 by fastening lower strap 26*b* to the upper strap 26*a* on both sides of the occupant together; and, 13). installing the umbrella 95, if desired, based upon an amount of ambient sunlight, by inserting an umbrella pole 96 into the umbrella aperture 97.

Accordingly, a user of the disclosed apparatus 10 benefits from available use of both arms to attend to other tasks or to play with the occupant in the water.

Another embodiment of the disclosed method for installing and utilizing the apparatus 10 as a floating vessel upon the water surface 105 (e.g., separate from the frame assembly 80) may be include a series of steps, including: 1). removing the knob 45 from the pivot rod 40; 2). sliding the pivot rod 40 outwardly from the first 64*a* and second 64*b* rod apertures; 3). removing the seat assembly 20; 4). placing the seat assembly 20 upon the water surface 105; 5). placing an occupant within the seat compartment 24; 6). securing the occupant by fastening the straps 26*a*, 26*a* together; and, 7). utilizing the seat assembly 20 and flotation member 32 of the apparatus 10 to support the occupant upon the water surface 105 while a care giver provides close supervision.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A child seat apparatus for use in a swimming pool, said apparatus comprising:
- a floatable seat assembly configured to support a child occupant upon a water surface;
- a frame assembly removably connected to said seat assembly and supported on a bottom surface of said swimming pool; and,
- a vertical adjusting assembly movably connected to said frame assembly, said vertical adjusting assembly comprising:
  - a pair of handles operatively connected to said frame assembly, wherein said pair of handles are height adjustable relative to said frame assembly; and,
  - a pivot rod interconnected between said pair of handles;
  - wherein said seat assembly is connected to said pivot rod.

2. The apparatus of claim 1, wherein said seat assembly comprises:
- a flotation member; and,
- a seat frame defining a seat compartment connected to said flotation member.

3. The apparatus of claim 2, wherein said seat frame comprises:
- a back rest located at an upper rear end of said seat compartment;
- upper safety straps connected to a rear wall of said seat compartment; and,
- lower safety straps connected to a floor of said seat compartment;
- wherein said upper safety straps and said lower safety straps are releasably connected to secure said child occupant within said seat compartment.

4. The apparatus of claim 2, wherein said seat assembly further comprises leg apertures extending from said seat compartment through said seat frame and said flotation member.

5. The apparatus of claim 1, wherein said frame assembly is height adjustable.

6. The apparatus of claim 1, further comprising a weighted base connected to said frame assembly to anchor said seat assembly to said bottom surface of said swimming pool.

7. The apparatus of claim 6, wherein said weighted base comprises a filler material comprising a density greater than water.

8. The apparatus of claim 7, wherein said filler material comprises at least one of concrete, sand, and gravel.

9. The apparatus of claim 1, wherein said seat assembly is rotatably connected to said frame assembly.

10. The apparatus of claim 1, wherein said frame assembly comprises:
- an opposed pair of side frames, each side frame comprising an inverted V-shape;
- a rear frame member interconnecting said pair of side frames; and,
- a front frame member interconnecting said pair of side frames.

11. A child seat apparatus for use in a swimming pool, said apparatus comprising:
- a frame assembly comprising an opposed and parallel pair of side frames;
- a vertical adjusting assembly movably connected to said pair of side frames;
- a floatable seat assembly connected to said vertical adjusting assembly between said pair of side frames, comprising:
  - a flotation member;
  - a seat frame connected to said flotation member, said seat frame defining a seat compartment;
  - leg apertures extending from said seat compartment through said seat frame and said flotation member;
  - a back rest connected to an upper end of a rear wall of said seat frame defining said seat compartment;
  - an accessory tray connected to said seat frame and extending outwardly from said seat compartment;
  - upper safety straps connected to said rear wall of said seat frame defining said seat compartment; and,
  - lower safety straps connected to a floor of said seat frame defining said seat compartment;
  - wherein said upper safety straps and said lower safety straps are releasably connected to secure said child occupant within said seat compartment; and,
- a weighted base connected to said frame assembly.

12. The apparatus of claim 11, wherein said seat assembly is pivotally connected to said vertical adjusting assembly.

13. The apparatus of claim 11, wherein said frame assembly further comprises:
- a rear frame member interconnecting said pair of side frames; and, a front frame member interconnecting said pair of side frames;

wherein said rear frame member and said front frame member are removably connected to said weighted base.

14. The apparatus of claim 13, wherein said vertical adjusting assembly comprises:

a pair of handles operatively connected to said pair of side frames, wherein said pair of handles are vertically adjustable relative to said frame assembly; and, a pivot rod interconnected between said pair of handles;

wherein said seat assembly is connected to said pivot rod.

15. The apparatus of claim 14, wherein said seat assembly further comprises a rod aperture extending completely through said flotation member, and wherein said pivot rod is received through said rod aperture.

16. The apparatus of claim 15, wherein each of said pair of handles comprises a rod aperture, and wherein said pivot rod is receivably connected to said pair of handles within said rod apertures.

17. The apparatus of claim 16, further comprising an umbrella removably connected to said seat assembly.

* * * * *